US005101555A

United States Patent [19]

Hauser

[11] Patent Number: 5,101,555

[45] Date of Patent: Apr. 7, 1992

[54] METHOD OF ASSEMBLING A REFRIGERENT COMPRESSOR

[75] Inventor: Bret R. Hauser, Garland, Tex.

[73] Assignee: Sanden Corporation, Gunma, Japan

[21] Appl. No.: 677,453

[22] Filed: Mar. 29, 1991

Related U.S. Application Data

[62] Division of Ser. No. 448,974, Dec. 12, 1989, abandoned.

[51] Int. Cl.[5] ..... B23P 15/00

[52] U.S. Cl. ..... 29/888.02; 29/888.3; 29/428

[58] Field of Search ..... 29/888.02, 888.3, 428; 277/231, 233, 235 R, 211; 92/60.5; 417/454; 428/156; 156/220

[56] References Cited

U.S. PATENT DOCUMENTS

| | | |
|---|---|---|
| 1,727,732 | 9/1929 | Ryan . |
| 1,782,014 | 11/1930 | Rimmelspacher . |
| 2,647,683 | 8/1953 | Schweller . |
| 3,549,157 | 12/1970 | Von Bennigsen . |
| 3,861,829 | 1/1975 | Roberts et al. . |
| 4,011,029 | 3/1977 | Shimuzu . |
| 4,023,248 | 5/1977 | Ozeki et al. . |
| 4,039,270 | 8/1977 | Hiraga . |
| 4,283,166 | 8/1981 | Hiraga . |
| 4,423,544 | 1/1984 | Kashmerick et al. . |
| 4,532,685 | 8/1985 | Itoh et al. . |
| 4,547,131 | 10/1985 | Riffe . |
| 4,620,475 | 11/1986 | Watts . |
| 4,719,065 | 1/1988 | Gibbon . |
| 4,722,671 | 2/1988 | Azami et al. . |
| 4,752,190 | 6/1988 | Fry . |
| 4,776,073 | 10/1988 | Udagawa . |
| 4,782,738 | 11/1988 | Jackson et al. . |
| 4,822,062 | 4/1989 | Gallo et al. . |
| 4,852,893 | 8/1989 | Wesley . |

*Primary Examiner*—Irene Cuda

*Attorney, Agent, or Firm*—Banner, Birch, McKie & Beckett

[57] ABSTRACT

A method of assembling a slant plate type compressor includes forming gaskets. The method includes forming gaskets in a plurality of at least five different thicknesses such that two thinner types of gasket have steel cores and the three thicker types of gaskets have aluminum cores. All five of the gasket thicknesses are given essentially the same compressibility by embossing the periphery of the gaskets with an identical embossment tool such as to give each gasket an embossment having the same height and width.

9 Claims, 4 Drawing Sheets

METHOD OF ASSEMBLING A REFRIGERENT COMPRESSOR

This application is a division of application Ser. No. 448,974, filed Dec. 12, 1989, abandoned.

BACKGROUND OF THE INVENTION

1. Technical Field

The present invention relates to a method of making gaskets and more particularly, to a method of manufacturing gaskets having substantially uniform compressibility for use with refrigerant compressors such as slant plate type compressors or other mechanisms making use of gaskets.

2. Description of the Prior Art

Slant plate type piston compressors with both fixed and variable capacity are known in the art. Variable capacity compressors are provided with a displacement or capacity adjusting mechanism to control the compression ratio of the compressor in response to demand. As disclosed in U.S. Pat. No. 3,861,829, the compression ratio may be controlled by changing the slant angle of the sloping surface of the slant plate in response to the operation of a valve control mechanism. The slant angle of the slant plate is adjusted in response to a change in suction chamber pressure to maintain the suction chamber pressure to a constant level.

The construction of a slant plate type compressor, specifically a variable capacity wobble plate type refrigerant compressor in accordance with one embodiment of the prior art is shown in FIG. 1. Compressor 10 includes cylindrical housing assembly 20 further including cylinder block 21, front end plate 23 at one end of cylinder block 21, crank chamber 22 enclosed within cylinder block 21 by front end plate 23, and rear end plate 24 attached to the other end of cylinder block 21. Front end plate 23 is mounted on cylinder block 21 forward of crank chamber 22 (to the left in FIG. 1) by a plurality of bolts 101. Rear end plate 24 is mounted on cylinder block 21 at its rearward end by a plurality of bolts (not shown). Rear end plate 24 includes centrally located discharge chamber 251 and peripheral annular suction chamber 241 located around discharge chamber 251. Valve plate 25 is disposed between rear end plate 24 and cylinder block 21. Rear end plate 24 also includes inlet portion 241*a* linking suction chamber 241 with an evaporator of an external cooling circuit (not shown), and outlet portion 251*a* linking discharge chamber 251 to a condenser of the cooling circuit (not shown). Cylinder block gasket 27 and cylinder head gasket 28 are disposed between cylinder block 21 and the inner surface of valve plate 25 and the outer surface of valve plate 25 and rear end plate 24, respectively. Gaskets 27 and 28 seal the mating surfaces of cylinder block 21, valve plate 25, and rear end plate 24.

Bearing 30 is disposed within opening 231 centrally formed in front end plate 23. Bearing 30 supports drive shaft 26 within opening 231. Bearing 31 is disposed within central bore 210 formed in cylinder block 21. Bearing 31 rotatably supports the inner end portion of drive shaft 26 within central bore 210. Cavity 220 is formed in cylinder block 21 to the rear of and adjacent to bore 210. Valve control mechanism 19 of a known type is disposed within cavity 220. Hole 220*a* is formed in cylinder block 21 and links cavity 220 and bore 210. Cylinder block 21 further includes conduit 221 linked to cavity 220 and hole 222 formed through valve 25. Holes 27*a* and 28*a* are also provided through gaskets 27 and 28 respectively, linking conduit 221 to suction chamber 241.

Cam rotor 40 is fixed on drive shaft 26 by pin member 261 and rotates with drive shaft 26. Thrust needle bearing 32 is disposed between the inner end surface of front end plate 23 and the adjacent axial end surface of cam rotor 40. Cam rotor 40 includes arm 41 having pin member 42 extending therefrom. Sliding element 54 is disposed on drive shaft 26. Slant plate 50 includes opening 53 and is disposed adjacent to cam rotor 40. Slant plate 50 is disposed around sliding element 54 for movement thereabout to adjust the slant or inclined angle of slant plate 50 with respect to a plane perpendicular to the longitudinal axis of drive shaft 26. Slant plate 50 includes arm 51 having slot 52. Cam rotor 40 and slant plate 50 are connected via pin member 42 inserted in slot 52 to create a hinged joint. Pin member 42 is slidable within slot 52 to allow adjustment of the slant angle of slant plate 50. Slant plate 50 rotates with cam rotor 40.

Wobble plate 60 is nutatably mounted on slant plate 50 through bearings 61 and 62. Sliding rod 64 is fixed between front end plate 23 and cylinder block 21. Slider 63 is attached to one peripheral end of wobble plate 60 and is slidably mounted on sliding rod 64, allowing wobble plate 60 to nutate along sliding rod 64 when cam rotor 40 rotates, but preventing rotation of wobble plate 60. Cylinder block 21 includes a plurality of peripherally disposed cylinder chambers 70. One piston 71 reciprocates in each cylinder chamber 70 and is connected to the peripheral end of wobble plate 60 by a corresponding connecting rod 72.

Valve plate 25 includes a plurality of suction ports 242 linking suction chamber 241 with respective cylinders 70. Valve plate 25 also includes a plurality of discharge ports 252 linking discharge chamber 251 with respective cylinders 70. Cylinder block gasket 27 includes a central portion and a plurality of circular openings 271 disposed over the open ends of cylinders 70. Cylinder head gasket 28 includes central star-shaped opening 282 at the location of discharge ports 252 and holes 281 disposed over suction ports 242. Suction reed valve element 260 is disposed between cylinder block gasket 27 and valve plate 25 and discharge reed valve element 290 is disposed between valve plate 25 and gasket 28. Holes 272 in cylinder block gasket 27, corresponding holes 250 through valve plate 25 and holes 283 through gasket 28 are provided to allow front end plate 24 to be fixed to cylinder block 21 by a plurality of screws (not shown).

When the compressor is operated, drive shaft 26 is rotated by the engine of the vehicle through electromagnetic clutch 300. Cam rotor 40 rotates with drive shaft 26, rotating slant plate 50 as well, and causing wobble plate 60 to nutate. Nutational motion of wobble plate 60 reciprocates pistons 71 in their respective cylinders 70. As pistons 71 are reciprocated, refrigerant gas introduced into suction chamber 241 through inlet portion 241*a* flows into each cylinder 70 through suction ports 242 and is compressed in the cylinders. Compressed gas is discharged from cylinder 70 to discharge chamber 251 through discharge ports 252, and from discharge chamber 251 to the external cooling circuit through outlet portion 251*a*.

During operation of the compressor, the suction chamber pressure will change, for example, in response to a change in the heat load of the evaporator or to a change in the rotation speed of drive shaft 26. Additionally, the capacity of compressor 10 is dependent upon the slant angle of slant plate 50 and wobble plate 60. When the pressure in crank chamber 22 increases, the slant angle of the slant plate and the wobble plate decreases, thereby decreasing the capacity of the compressor. When the crank chamber pressure decreases, the slant angle increases, and the capacity of the compressor is increased. Valve control mechanism 19 functions to maintain a predetermined suction chamber pressure in response to changes in the suction chamber pressure, that is, valve control mechanism 19 functions to restore the suction chamber pressure to a predetermined value when it changes. Since valve control mechanism 19 controls the link between the crank chamber and the suction chamber through passageway 17, valve control mechanism 19 controls the pressure within the crank chamber and thus functions to control the slant angle of the wobble plate and the slant plate to control the capacity of the compressor.

With further reference to FIGS. 2–5, cylinder block 21 includes central depression 213. When the compressor is assembled, the central portion of cylinder block gasket 27 is pressed against central depression 213 by valve plate 25 such that an indented region is formed as shown by dotted lines 273. Therefore the central portion fits into central depression 213. A slight gap 400 remains between cylinder block gasket 27 and cylinder block 21 at the periphery of depression 213 as shown in FIG. 2. Suction reed valve element 260 includes central portion 261 and a plurality of reed elements 262 extending radially therefrom. Central portion 261 of suction reed valve element 260 fits with the indented region of cylinder block gasket 27 such that reeds 262 extend within opening 271 and cover suction ports 242, and holes **262*a* in reed element 262 are disposed over discharge ports 252. When pistons 71 are reciprocated away from gaskets 27, reed elements 262 are drawn away from suction ports 242, and refrigerant is drawn into cylinders 70 through ports 242. When pistons 71 are reciprocated towards cylinder block gasket 27, reed elements 262 are forced towards valve plate 25 so as to cover suction ports 242, and the compressed refrigerant flows though holes 262*a*, and discharge ports 252 into discharge chamber 351. Suction reed valve element 260 is disposed within essentially the same plane as the non-indented region of cylinder block gasket 27**.

Star-shaped discharge reed valve element 290 is fixed to the opposite side of valve plate 25 and includes reed elements 291 which extend radially so as to cover discharge ports 252. Cylinder head gasket 28 includes star-shaped center opening 282 disposed radially outwardly of reed elements 291, allowing reed elements 291 to flex therein. When pistons 71 are reciprocated away from valve plate 25, reed elements 291 are drawn towards and cover discharge ports 252, preventing back flow of refrigerant therethrough. Refrigerant flows from suction chamber 241 through holes 281 of gasket 28 and suction ports 242 into cylinders 70. When piston 71 is reciprocated towards valve plate 25, reed elements 291 flex away from discharge ports 252, allowing refrigerant fluid to flow into discharge chamber 251.

The provision of gaskets 27 and 28 seals the compressor against refrigerant leaks, both to the exterior of the compressor, and between adjacent cylinder 70. The leaks are caused by gaps which are created between the various components of the compressor during assembly due to manufacturing tolerances. The leaks adversely effect compressor operation by reducing capacity. In manufacturing prior art compressors, gaskets made of asbestos fibers have typically been used. The gaskets are generally flat, and have a high degree of compressibility. Generally a plurality of flat gaskets of a plurality of different thicknesses, for example, five thickness, have been manufactured. When the compressors are assembled, the distance between the piston at the top dead center position and the end surface of the cylinder block is measured and compared to a predetermined desired range of clearance. Then, a cylinder block gasket of an appropriate thickness is selected such that when the compressor is assembled with the gasket between the cylinder block and the valve plate, the distance between the piston at top dead center position and the valve plate is within the predetermined clearance range.

Due to their high compressibility, asbestos gaskets allow uniform sealing of the compressor to avoid refrigerant leaks. However asbestos gaskets allow refrigerant to leak due to seepage, and are prone to rupture after extended compressor operation. Furthermore, the health hazards to workers both in the manufacture of the gaskets and the assembly of the compressors are well known. Therefore as one alternative, it is known to use rubber coated metal gaskets (RCM) in place of the asbestos fiber gaskets to overcome these hazards. Generally, a single metal covered with a rubber coating has been used. The RCM's are manufactured in a plurality of thickness, for example, five, and as with the asbestos gaskets, during manufacture of the compressor an RCM gasket of appropriate thickness is selected so as to obtain a desired clearance. However, RCM gaskets are much less compressible than asbestos fiber gaskets. Thus, when the compressors are assembled, the sealing provided by the RCM gaskets is not as effective as that provided by the asbestos gaskets.

One way to overcome this problem is to provide an embossment such as embodiment 275 around the periphery of cylinder block gaskets 27 at a location exterior of circular openings 271. However, the deformability and thus compressibility of RCM gaskets are dependent on the size of the embossment in relation to the thickness of the gasket for a given core metal. That is, the thicker the gasket, the larger the embossment needed to obtain a predetermined or constant compressibility among all of the various thicknesses of the gaskets. If only one set of embossment tooling is used to emboss the gaskets of different thicknesses, the result will be a plurality of gaskets having identical-sized embossments, and thus different compressibilities. For example, if five gasket thicknesses are used, and the size of the embossment is selected so as to provide the desired compressibility for the thickest gasket, then all of the gaskets of the other thicknesses will have too great a compressibility. The result, especially for the thinnest gaskets, will be a greater than desired deformation when the compressor is assembled, causing undesired refrigerant leakage as well as a piston and valve plate clearance which is not in the predetermined range. If the embossment size were selected so as to provide the desired compressibility for the thinnest gasket, than all of the other gaskets will have too little deformability and compressibility. The result, especially for the thickest gasket, will be gaskets which are too stiff and which do not deform enough when the compressor is assembled. Again, refrigerant leakage and a non-desired clearance will result. Even if the embossment size were selected so as to give the ideal compressibility to the medium thickness gasket, the thinnest and thickest gasket will have either more or less compressibility, respectively than desired.

One way to overcome this problem is shown in FIG. 6*a* and 6*b* in which cross-sections along the C—C in FIG. 4 for gaskets of two different thicknesses are shown. In FIG. 6*a*, cylinder block gasket 27*a* has thickness $t_1$, and includes embossment 275 having width $w_1$ and height $h_1$. FIG. 6*b* shows cylinder block gasket 27*b* having thickness $t_2$ and embossment 275 having height $h_2$ and width $w_2$. Since thickness $t_2$ is less than thickness $t_1$, height $h_2$ and width $w_2$ are selected to be different than height $h_1$ and width $w_1$. In FIG. 6, height $h_2$ and width $w_2$ are shown as being less than height $h_1$ and width $w_1$. Thus, both gaskets 27*a* and 27*b* are manufactured to have the desired deformability and compressibility upon assembly of the compressor. However, in order to make gaskets having different sized embossments, it is necessary to use separate embossment tooling. The use of different sets of tooling is expensive, and in general at least five different gaskets thicknesses must be manufactured for assembly into the compressor. Moreover, each time it is necessary to emboss gaskets of different thicknesses, the tooling would need to be changed, again increasing the expense.

SUMMARY OF THE INVENTION

The present invention discloses a method for producing a plurality of rubber coated metal gaskets of different thicknesses having substantially the same compressibility. The gaskets are formed out of at least two different core metals, and are embossed with an embossment of identical height and width for all thicknesses.

In a further embodiment, the gaskets comprise two groups such that the thinner gaskets have steel cores and the thicker gaskets have aluminum cores.

In a further embodiment, the embossment has a width of 2.5 mm and a height of 0.4 mm.

In a further embodiment, five gasket thicknesses are manufactured with the three thickest gaskets having aluminum cores and the thinnest two having steel cores.

In a still further embodiment, the gaskets are disposed in a slant plate type compressor.

One advantage provided by the present invention is that by using only one set of tooling, the gaskets are inexpensively manufactured. However, by using two different core metals, the compressibility of the gaskets is more uniform among the various thickness of the gaskets. Thus, refrigerant leaks are prevented.

Further objects, features, and other aspects of this invention will be understood from the detailed description of the preferred embodiment with reference to the drawings.

DETAILED DESCRIPTION OF THE PREFERRED EMBODIMENTS

Figure 1:
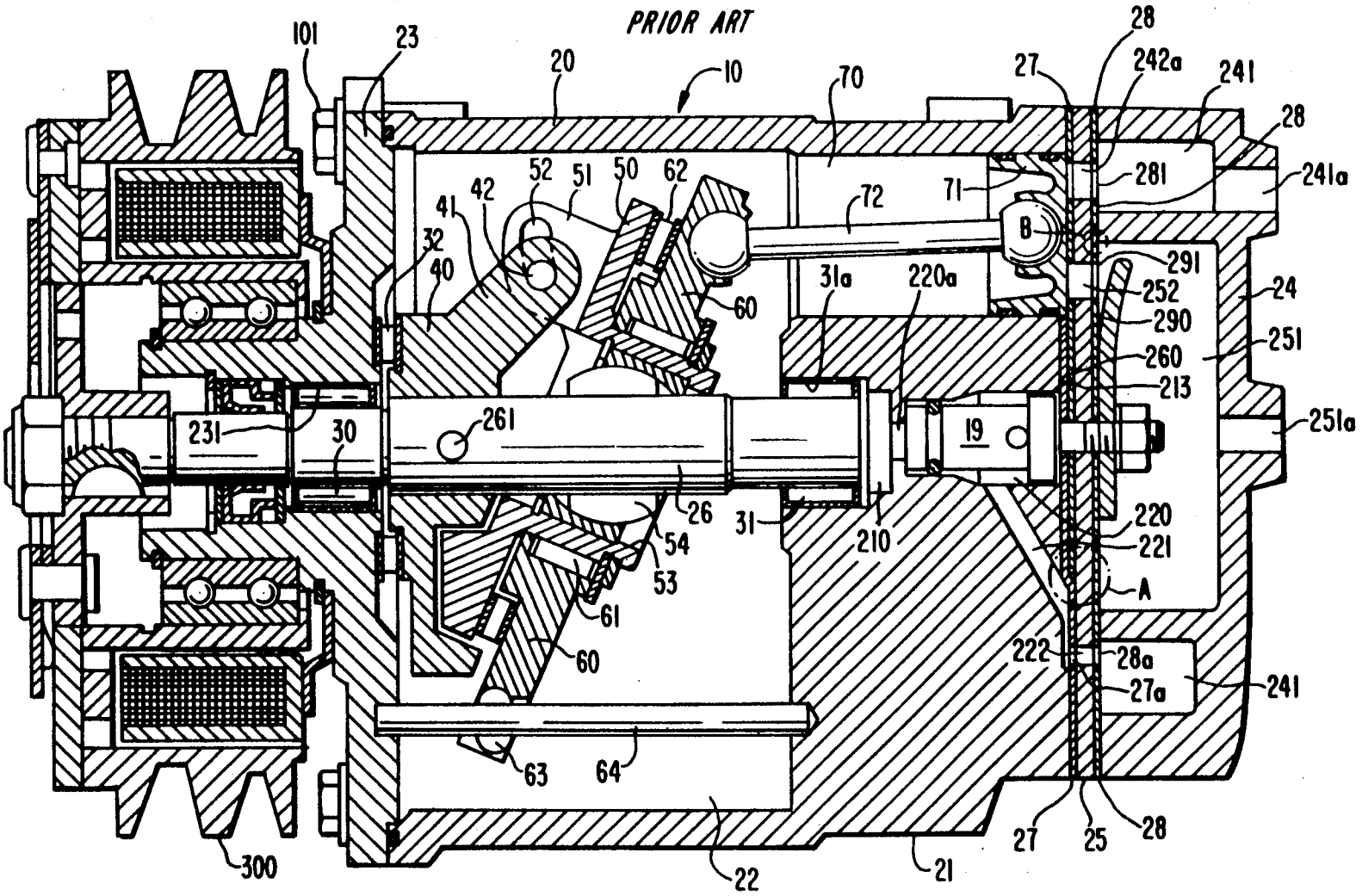
FIG. 1 PRIOR ART
FIG. 1 is a vertical longitudinal-sectional view of a slant plate type compressor according to the prior art.
Figure 2:
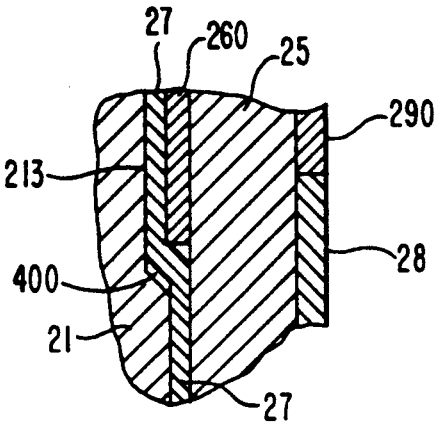
FIG. 2 PRIOR ART
FIG. 2 is a close-up view of circle A shown in FIG. 1.
Figure 3:
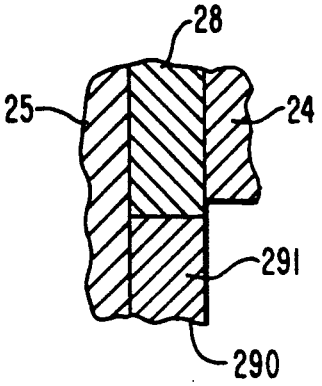
FIG. 3 PRIOR ART
FIG. 3 is a close-up view of circle B shown in FIG. 1.
Figure 4:
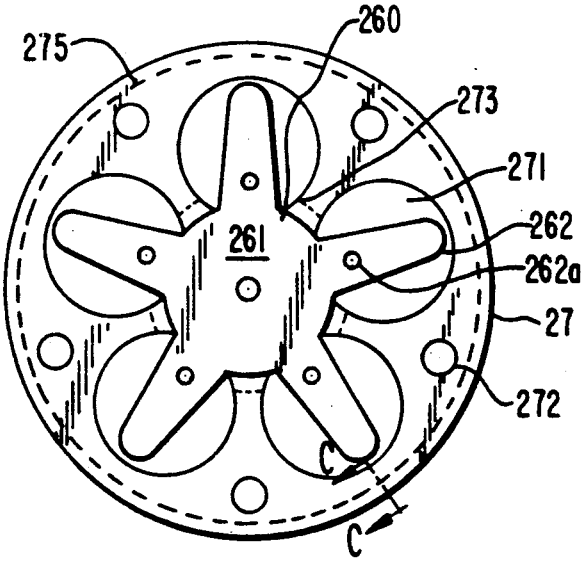
FIG. 4 PRIOR ART
FIG. 4 is a front view of a gasket and suction reed valve element shown in FIG. 1.
Figure 5:
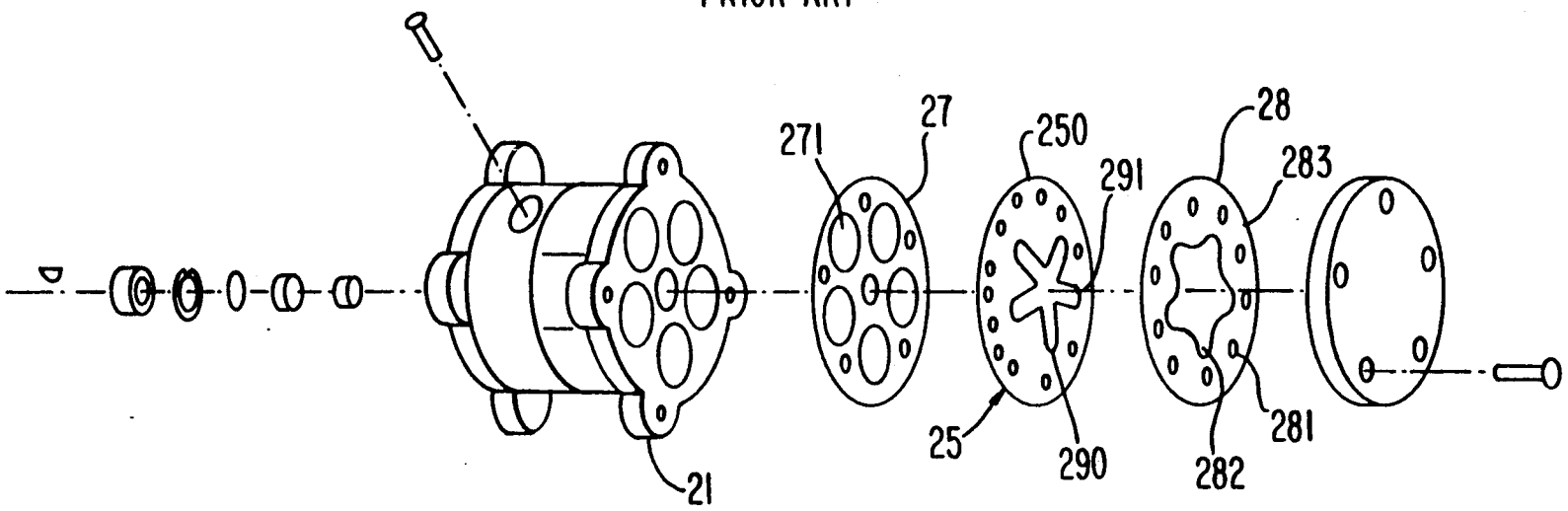
FIG. 5 PRIOR ART
FIG. 5 is an exploded view of the compressor shown in FIG. 1.
Figure 6A:
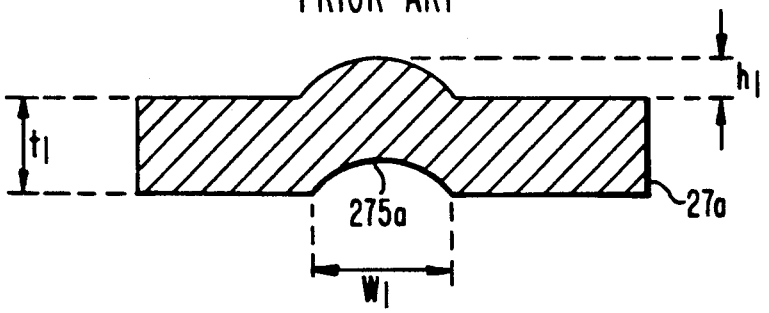
FIG. 6a PRIOR ART
FIGS. 6*a*–6*b* are a cross-sectional view along line C—C shown in FIG. 4 for a gasket according to the prior art.
Figure 6B:
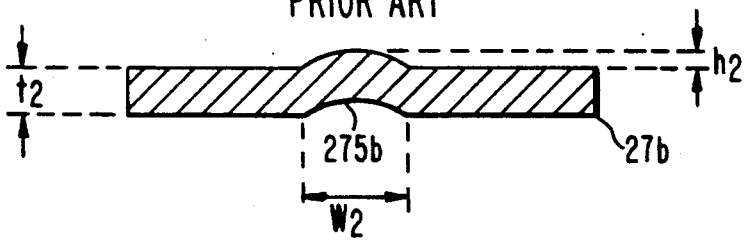
FIG. 6b PRIOR ART
Figure 7A:
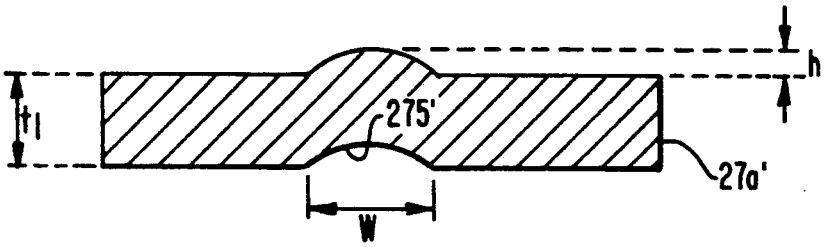
FIGS. 7*a*–7*b* are a cross-sectional view along line C—C shown in FIG. 4 for a gasket according to the present invention.
Figure 7B:
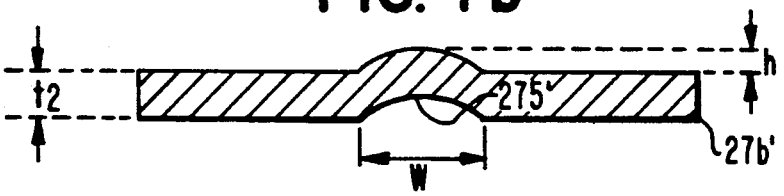

With reference to FIGS. 7*a*–7*b*, cross-sections of gaskets including embossments according to the present invention are shown. Cylinder block gaskets 27*a*' and 27*b*' of FIG. 7*a*–7*b* are to be used in the prior art compressor shown in FIGS. 1–5, in place of gaskets 27*a* and 27*b* of FIGS. 6*a*–6*b*. In all other respects, compressor 10 is identical in the present invention. Therefore detailed description of the compressor is omitted. Additionally, gaskets 27*a*' and 27*b*' of the present invention may be used in many types of compressors, including slant plate compressors or both the wobble or swash plate type, having both fixed or variable displacements. Moreover, the use of the gaskets is not limited to slant plate compressors, and they may be used in other types of compressors such as reciprocating compressors, or other types of machines such as motors or engines.

RCM gaskets 27*a*' and 27*b*' of the present invention are made of metal cores coated with rubber. A plurality of different metals may be used for the cores. For example, at least two core metals such as aluminum and steel may be used. Since steel is far less compressible than aluminum, steel is used for the thinner gaskets. If five gaskets are used, than the thinner two may have steel cores and the thicker three would have aluminum cores. For all five gasket thicknesses, the same embossment size would be used. As shown in FIG. 7*a*, cylinder block gasket 27*a*' having thickness $t_1$ would also have an embossment 275' having width w and height h. As shown in FIG. 7*b*, gasket 27*b*' with thickness $t_2$ would have embossment 275' also having width w and height h. Even though thickness $t_1$ greater than thickness $t_2$, embossments 275' are identical. Even if five or more different thicknesses are used, embossment 275' would be identical for all thicknesses.

In the present invention, even though the embossment would have the same dimensions for different thicknesses, all of the gaskets would have substantially the desired amount of compressibility since the inherent deformability of the core metals is different. In the case of the two gaskets shown in FIGS. 7*a* and 7*b*, since the thicker gasket has a core made of highly deformable aluminum, it will have substantially the same overall compressibility as the thinner gasket made of relatively non-deformable steel, if the size of embossments 275' are identical.

Even thought only two thickness are shown, it is clear that a plurality of five or more different thicknesses may be used. For example, the steel core gaskets could having thicknesses of 0.3 and 0.4 mm, and the aluminum core gaskets could have thickness of 0.5, 0.6 and 0.77 mm. In the situation where two core metals are used with five thicknesses of the gaskets, the size of the embossment would be chosen as a compromise to give substantially the desired compressibility to all five gasket thicknesses. In a preferred embodiment, an embossment having a width substantially equal to 2.5 mm and a height substantially equal to 0.4 mm could be used with gaskets if these five thicknesses.

The present invention requires the use of only one set of embossment equipment, reducing the cost of manufacturing the gaskets while allowing production of gaskets of many thicknesses having substantially the desired compressibility. Additionally, by making use of gaskets having substantially the desired compressibility, the extent of gap 400 is reduced, thereby increasing the sealing effect provided by the gaskets. Finally, if desired, other metals could be used as the core metals so as to allow the manufacture of gaskets having increasingly desirable compressibility characteristics.

This invention has been described in detail in connection with the preferred embodiments. These embodiments, however, are merely for example only and the invention is not restricted thereto. It will be understood by those skilled in the art that other variations and modifications can easily be made within the scope of this invention as defined by the appended claims.

I claim:

1. A method of assembling a slant plate type refrigerant compressor including a compressor housing having a cylinder block, a rear end plate disposed at one end of said cylinder block, said cylinder block having a plurality of cylinders therein, a piston slidably fitted within each of said cylinders, a drive mechanism coupled to said pistons to reciprocate said pistons within said cylinders, said drive mechanism including a drive shaft rotatably supported in said housing, a cam rotor coupled to said drive shaft and rotatable with said drive shaft, and coupling means including a slant plate coupling said rotor to said pistons for converting rotary motion of said rotor into reciprocating motion of said pistons, said slant plate having a surface disposed at an inclined angle relative to a plane perpendicular to said drive shaft, a valve plate disposed between said cylinder block and said rear end plate, and a cylinder block gasket disposed between said cylinder block and said valve plate, the method comprising the steps of:

producing a plurality of rubber coated metal cylinder block gaskets of different thicknesses having substantially the same compressibility, said gaskets divided into two groups according to thickness, each group having gaskets of at least one thickness, a first said group including only gaskets which are thinner than all of the gaskets in said second group, said gaskets in said first group formed of a different core metal than the gaskets of the second group;

embossing all of said gaskets with an embossment of identical height and width;

and assembling a selected cylinder block gasket into said compressor.

2. The method recited in claim 1, said gaskets of the first group having steel cores, said gaskets of the second group having aluminum cores.

3. The method recited in claim 2, said first group including steel core gaskets having thicknesses of 0.3 and 0.4 mm, said second group having aluminum core gaskets having thicknesses of 0.5, 0.6 and 0.77 mm.

4. The method recited in claim 3 said embossment having a width of 2.5 mm and a height of 0.4 mm.

5. The method recited in claim 2 said embossment having a width of 2.5 mm and a height of 0.4 mm.

6. The method recited in claim 1 said embossment having a width of 2.5 mm and a height of 0.4 mm.

7. The method recited in claim 1, the step of assembling a selected gasket further comprising the steps of:

measuring the distance between one said piston and the end surface of said cylinder block when the piston is in the top dead center position;

comparing the measured distance to a predetermined desired range of clearance between the piston and said valve plate when the piston is in the top dead center position; and selecting a cylinder block gasket having a thickness such that when said compressor is assembled with said gasket between said cylinder block and said valve plate, the distance between the piston and the valve plate when the piston is in the top dead center position is within the predetermined clearance range.

8. A method of assembling a refrigerant compressor including a compressor housing having a cylinder block, a rear end plate disposed at one end of said cylinder block, said cylinder block having a plurality of cylinders therein, a piston slidably fitted within each of said cylinders, a drive mechanism coupled to said pistons to reciprocate said pistons within said cylinders, a valve plate disposed between said cylinder block and said rear end plate, and a cylinder block gasket disposed between said cylinder block and said valve plate, the method comprising the steps of: producing a plurality of rubber-coated metal cylinder block gaskets having substantially the same compressibility by forming at least two groups of gaskets, each group having gaskets made of a different core metal from the gaskets in any other group, and embossing the gaskets in all of said groups with an embossment of identical height and width;

and assembling a selected cylinder block gasket into said compressor.

9. The method recited in claim 8, said drive mechanism including a drive shaft rotatably supported in said housing, a cam rotor coupled to said drive shaft and rotatable with said drive shaft, and coupling means including a slant plate coupling said rotor to said pistons for converting rotary motion of said rotor into reciprocating motion of said pistons, said slant plate having a surface disposed at an inclined angle relative to a plane perpendicular to said drive shaft.

* * * * *